United States Patent [19]

Albee, Jr.

[11] Patent Number: 4,735,393

[45] Date of Patent: Apr. 5, 1988

[54] SHEET CLAMP FOR EASEL

[75] Inventor: Percy F. Albee, Jr., Bristol, R.I.

[73] Assignee: Q-Panel Corporation, Providence, R.I.

[21] Appl. No.: 48,590

[22] Filed: May 11, 1987

[51] Int. Cl.[4] ..... A47G 1/24

[52] U.S. Cl. ..... 248/452; 24/455; 248/316.1; 248/316.3

[58] Field of Search ..... 248/452, 451, 450, 313, 248/312.1, 316.1, 316.3, 359.1; 24/522, 543, 455; 211/45

[56] References Cited

U.S. PATENT DOCUMENTS

| | | | |
|---|---|---|---|
| 943,865 | 12/1909 | Flanders | 248/452 |
| 965,720 | 7/1910 | Limpus | 248/452 |
| 2,053,517 | 9/1936 | Crandall et al. | 248/359.1 |
| 2,570,439 | 10/1951 | Forca | 248/452 |
| 3,106,799 | 10/1963 | Gawthrop | 248/452 |
| 3,195,849 | 7/1965 | Maddox | 248/452 X |
| 3,247,695 | 2/1969 | Cowan | 248/452 X |
| 3,325,134 | 6/1967 | Henry | 248/316.3 X |
| 4,085,848 | 4/1978 | Tsuge | 211/45 |
| 4,150,807 | 4/1979 | Manso | 248/452 |

*Primary Examiner*—Ramon O. Ramirez
*Attorney, Agent, or Firm*—Barlow & Barlow, Ltd.

[57] ABSTRACT

In an easel, a clamp for suspending sheets or other objects is formed with an elongated plate and a pair of brackets that support a bar. The brackets are particularly formed so that they incline downwardly towards the plate upon which they are mounted and the bar is arranged to be slidingly affixed to the brackets. The bar slides up and down and may grip objects placed between it and the plate. Ideally, the bar is provided with cushion means which provide the actual gripping action against the plate.

3 Claims, 1 Drawing Sheet

SHEET CLAMP FOR EASEL

BACKGROUND OF THE INVENTION

This invention relates primarily to easels such that are used for displaying charts, that would be used by lecturers. In the past, a top bar across an easel, has been provided with some form of a clip. A typical clip of the prior art is seen in the Cowan U.S. Pat. No. 3,427,695. Other approaches to the same problem are seen in the Schoenfeld U.S. Pat. No. 2,760,288 and the Aoi U.S. Pat. No. 3,434,686. Devices of the prior art are awkward to use and, in general require two handed operation to open a spring type clip or the like or to manipulate other forms as illustrated in the prior art. The instant invention solves the problem by providing a simple clamping type device which provides a bar that slides on two framed brackets which are angled towards the back plate associated with the easel, the bar operting by gravity and having gripper portions thereon which actually engage sheets or pads.

SUMMARY OF THE INVENTION

The present easel clamp is associated with a top bar that may be readily clipped onto an easel. Once the easel is set up in its expanded condition, the top elongated plate may be placed on the easel, which plate has a pair of spaced brackets that have a portion thereof that overlie the plate and are inclined downwardly towards the plate. Slidingly mounted in the brackets is a bar that extends between the brackets, the bar moving by gravity toward the plate, the bar preferably having on its surface facing the plate, cushion means, which will engage sheets or paper pads commonly used by lecturers.

DESCRIPTION OF THE PREFERRED EMBODIMENT

Figure 1:
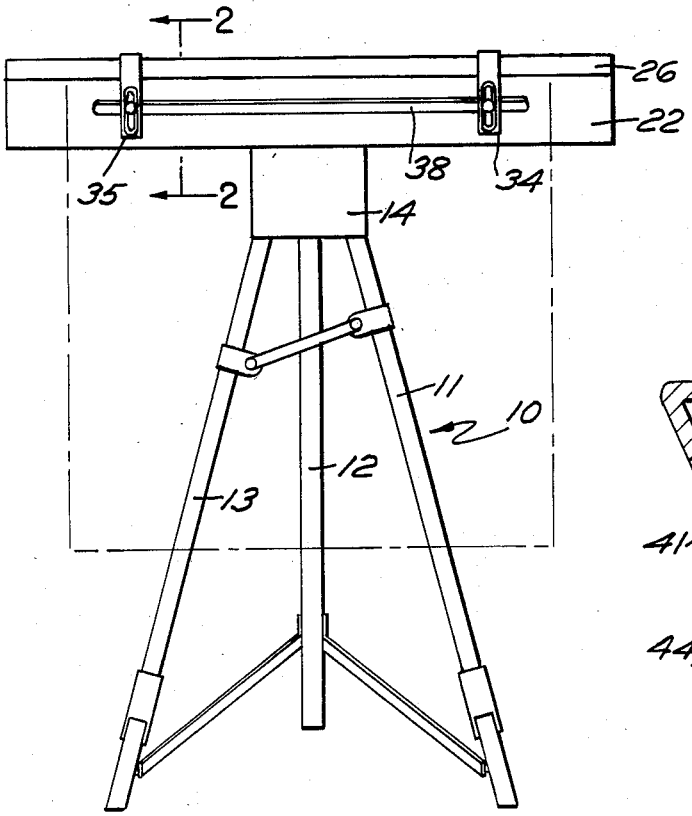
FIG. 1 is a perspective view of an easel fitted with the clamping device of the invention.

Referring first to FIG. 1, by way of example, the easel which is designated generally 10 is illustrated as having three legs 11, 12, and 13 which are pivotally secured to a top member 14.

Suitably affixed to the top member 14 in a manner that is not important to the invention, is an elongated plate means 20 which has a horizontal leg portion 21 and a vertical leg portion 22. The vertical leg portion provides a surface for the reception of sheet material. An L-shaped top trim piece 24 is provided which has a horizontal portion 25 secured to the horizontal portion 21 and a depending leg portion 26 that lies spaced from the plate portion 20 as seen in the drawings, particularly FIGS. 2 and 3 thereof.

Mounted on the plate means 20 are a pair of spaced brackets 30 and 31 which are affixed by suitable means, herein illustrated as rivets, to the plate means 20. The brackets have an upper portion 32, 33, respectivelyl, which rest on the plate means, particularly the upper surface 25 and extend away therefrom a distance. At the outer terminus of the brackets, there is a bend to provide downwardly inclined portions 34 and 35 that are bent to inscribe an acute angle. In relationship to the face of the plate means, there is defined a triangular space. When viewing the easel from the frontal face thereof, portions 34, 35 are inclined downwardly toward the plate means.

Figure 2:
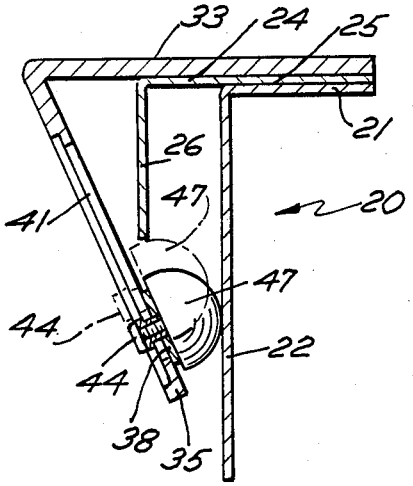
FIG. 2 is an enlarged sectional view taken on line 2—2 of FIG. 1.
Figure 3:
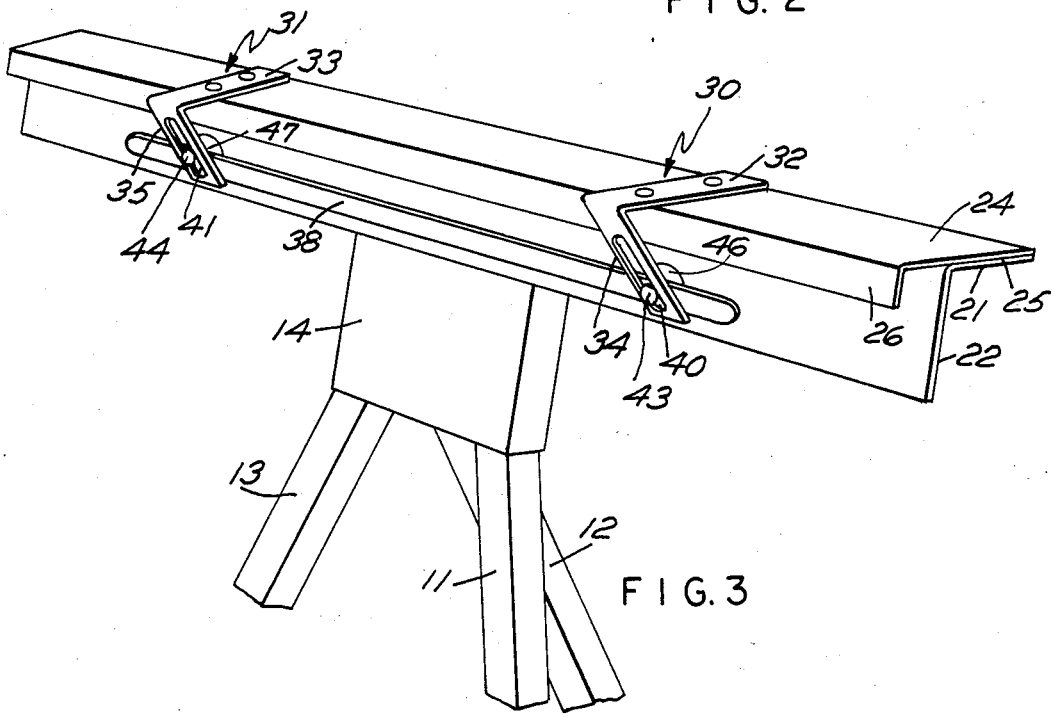
FIG. 3 is a perspective view illustrating the clamp of the invention in greater detail.

The clamp in its operative condition is seen in FIGS. 1 and 3. A bar 38 extends between the two brackets, generally designated 30, 31, and, in each of the downwardly directed portions 34, 35 of the bracket, there is provided a slot 40, 41, respectively. A pair of fasteners 43,44 43 have heads that are engaged in the slots 40 and 41 and have shanks that engage chusion means 46, 47. As seen in broken lines in FIG. 2, by merely lifting the bar 38 the cushion means may leave an opening between itself and the plate means so as to permit a sheet to pass therein, whereupon the bar may be dropped and, by gravity, will fall downwardly, the cushion means gripping the sheet. When detaching a sheet from the device, the bar 38 is lifted upwardly which, as seen in FIG. 2, provides a space between the cushion means and the plate, thus enabling any sheet means or other object to be pulled downwardly and released.

The clamp for the easel described herein is designed with the principal object of suspending either a light thin object such as a sheet of bulletin paper or bulkier objects such as lecturer's pads but is sufficiently robust so that it will also suspend heavier objects such as metal plates, provided the proper cushion means are utilized for gripping purposes.

I claim:

1. In an easel a clamp for sheets arranged singly or in multiple layers comprising a substantially elongated plate having a horizontal leg portion and a vertical leg portion, said plate supported by said easel, a pair of spaced brackets having a first portion secured to the plate horizontal leg portion and a second portion inclined downwardly toward the plate vertical leg portion, a bar extending between said brackets, said bar being vertically slidably affixed to each of the bracket second portions to lie between the brackets and the plate whereby gravity may urged the bar toward the plate vertical leg portion and grip sheets.

2. In an easel as in claim 1 wherein the bar is provided with a cushion on the face thereof juxtaposed to the plate serving as a friction means to prevent sheets from sliding.

3. in an easel, a suspension device for objects comprising an elongated plate having a horizontal leg portion and a vertical leg portion, a pair of spaced brackets each having a first portion secured to the plate horizontal leg, and a second portion angularly bent to define a triangular space tapering toward the plate vertical leg portion, clamp means supported on said second portions and slidably disposed thereon to slide up and down the said second portions in the space facing the plate vertical leg and grip objects against the plate.

* * * * *